United States Patent [19]

Smithers et al.

[11] Patent Number: 4,506,982

[45] Date of Patent: Mar. 26, 1985

[54] APPARATUS FOR CONTINUOUSLY BLENDING VISCOUS LIQUIDS WITH PARTICULATE SOLIDS

[75] Inventors: Richard Smithers, Phoenix; Carl B. May, Glendale, both of Ariz.

[73] Assignee: Union Oil Company of California, Los Angeles, Calif.

[21] Appl. No.: 523,700

[22] Filed: Aug. 16, 1983

Related U.S. Application Data

[63] Continuation of Ser. No. 289,244, Aug. 3, 1981, abandoned.

[51] Int. Cl.[3] ..... B28C 5/16; B28C 7/10; B28C 7/12

[52] U.S. Cl. ..... 366/19; 366/20; 366/22; 366/34; 366/35; 366/37; 366/65; 366/142; 366/156; 366/160; 366/329

[58] Field of Search ..... 366/14–17, 366/23, 24, 27, 33, 34, 35, 38, 51, 65, 152, 154, 160, 161, 162, 177, 305, 315–317, 30, 329, 149, 19, 20, 142, 156

[56] References Cited

U.S. PATENT DOCUMENTS

| | | | |
|---|---|---|---|
| 1,804,562 | 5/1931 | Kirshbraun et al. | 366/16 |
| 2,061,469 | 11/1936 | Krumbhaar | 366/149 X |
| 2,918,264 | 12/1959 | Ackles | 366/317 X |
| 4,298,288 | 11/1981 | Weisbrod | 366/35 X |
| 4,322,167 | 3/1982 | Hill | 366/51 X |
| 4,323,313 | 4/1982 | Oberg et al. | 366/162 X |

FOREIGN PATENT DOCUMENTS

| | | | |
|---|---|---|---|
| 1281402 | 10/1968 | Fed. Rep. of Germany | 366/316 |

*Primary Examiner*—Timothy F. Simone

*Attorney, Agent, or Firm*—Robert J. Baran; Gregory F. Wirzbicki; Dean Sandford

[57] ABSTRACT

An apparatus for continuously blending a viscous liquid, such as hot asphalt, with particulate solids, such as ground rubber, includes a vertical cylindrical tank in which is disposed a smaller vertical vessel defining therein a blending chamber. Open lower side regions of the vessel feed the blended slurry to a holding chamber defined between the vessel and tank. A shaft rotatably mounted through the blending chamber has fixed thereto a blending disc and two hollow blending cones coaxially mounted on opposite sides of the disc to form two shear-type blending regions. Hydraulically driven pumps and motors feed the viscous liquid and solids to the blending chamber, rotate the blender shaft and withdraw slurry from the holding region for use. Hydraulic flow control valves enable selectively variable feeding, blending and slurry discharge rates. The relative feed rates of the liquid and solids are preferably continuously monitored to assure the desired liquid/solid blend ratio. The apparatus may be mounted on a trailer or the like for ease of transportation.

24 Claims, 4 Drawing Figures

APPARATUS FOR CONTINUOUSLY BLENDING VISCOUS LIQUIDS WITH PARTICULATE SOLIDS

RELATED APPLICATIONS

This application is a continuation of copending application Ser. No. 289,244 filed Aug. 3, 1981, abandoned.

BACKGROUND OF THE INVENTION

1. Field of the Invention

The present invention relates generally to apparatus for blending viscous liquids with particulate solids, and more particularly to apparatus for blending hot asphaltic materials with ground rubber.

2. Description of the Prior Art

Currently there are considerable applications for blends of asphaltic material and ground rubber. Examples of such uses are stress absorbing pavement layers or membranes, either on top of or between other pavement layers; waterproof membranes for lakes, reservoirs and ground areas requiring stabilization and elastomeric coatings for roofs. The asphalt/rubber blends have considerably different properties than asphalt alone. In addition to have greater resiliance, the blends typically have superior low temperature and strength characteristics. Furthermore, since the rubber used is usually ground or pulverized reclaimed vehicle tires, use of asphalt/rubber blends also provides an environmentally acceptable means for disposing of scrap tires.

Numerous problems have heretofore been encountered in blending asphalt with rubber to form a relatively homogeneous slurry. Because the ground rubber is lighter in weight than the asphalt with which it is blended, the rubber tends to stay on or float to the top of slurry during blending operation. Consequently, comparatively long blending times have typically been required to produce a homogenous asphalt/rubber mixture with known blending apparatus. Besides limiting the rates at which the blends can be produced, long blending time at high temperatures, such as about 400° F., required to maintain the asphalt in a fluid state tend to devulcanize the rubber. This devulcanization results in release from the rubber of liquid petroleum products which typically soften the resulting asphalt product. For such reasons, rapid blending of the asphalt and rubber is highly desirable.

In the past, blending of asphalt with rubber has typically been by a batch process wherein comparatively large quantities of asphalt and rubber are mixed together in a large tank resembling a concrete mixer. Problems arise with such large batch mixing, however, if the use of the asphalt/rubber blend is delayed, such as may be a result of unfavorable weather conditions or equipment breakdown. When long delays do occur, the entire batch of rubberized asphalt may be ruined due to the abovementioned rubber devulcanization at high temperature.

Continuous flow blending of the asphalt and rubber is, as a result, much preferred over batch blending. However, the problem has been that the prior art apparatus are inadequate to provide sufficiently high blending rates to satisfy many commonly encountered job conditions and requirements. When continuous blend processing is excessively slow, as it heretofore has generally been, men and other equipment may be idled, thereby reducing efficiency and increasing job costs. Attempts to speed up the operation of known continuous flow blending apparatus have typically resulted in nonhomogeneous asphalt/rubber blends and/or a failure to adequately wet all of the rubber with asphalt, with a resulting reduction in the mechanical strength and integrity of the applied membranes or coatings.

Also, different jobs have different blending requirements, such as requiring different ratios of asphalt or asphaltic material to ground rubber. The need to use different mix ratios may result from use of varied asphaltic materials and/or from different strength, temperature or resiliency requirements for the resulting rubberized asphalt. Consequently, the ability to accurately vary asphalt/rubber blend ratios over comparatively wide ranges is highly desirable. However, accurately variable mixing ratios have not heretofore been readily obtainable with the prior art apparatus due, at least in part, to use of electrically driven supply pumps or material transfer devices which cannot provide the necessary wide range of speed control.

Furthermore, it is believed that provision has not heretofore been made for directly indicating the blend ratio, so as to enable improved blending control and readily blend ratio verification.

Accordingly, it is a primary object of this invention to provide an improved apparatus for continuously blending viscous liquids, such as asphalt, with particulate solids, such as ground rubber, so as to avoid the aforementioned deficiencies of the prior art apparatus.

Another object of the invention is to provide an apparatus capable of accurately blending viscous liquids and particulate solids to produce slurries having a wide variety of liquid to solids ratios.

Still another object of the invention is to provide an apparatus which can economically and effectively produce on a continuous basis a blend of hot asphalt and rubber of a selected liquid to solid ratio while allowing the continuous monitoring of the blending ratio to verify that the desired ratio is employed.

A further object of this invention is provide a relatively compact apparatus for continuously blending viscous liquids and solids at high rates such that said apparatus can be vehicle-mounted if desired.

Additional object, advantages and features of the invention will become apparent to those skilled in the art from the following description when taken in conjunction with the accompanying drawing.

SUMMARY OF THE INVENTION

An apparatus for continuously blending a viscous liquid with particulate solids to form a substantially homogeneous slurry comprises an outer tank and a blending vessel mounted therein so as to define (1) a blending chamber spaced inwardly from the walls of the tank and (2) a blended slurry holding chamber around the vessel and within the tank. The blending vessel is substantially closed except for a lower cylindrical section thereof which allows fluid communication from the blending chamber into the slurry holding chamber. The apparatus also includes a blender having a shaft rotatably mounted in the blending chamber with a blending disc and two mixing elements which are positioned a preselected distance above the bottom of the blending vessel. The two hollow coaxial blending elements are preferably conically shaped. One blending element is fixed to the shaft on one side of the disc, the other element being fixed to the shaft on the opposite side of the disc. Open larger diameter ends of the blending elements face the disc and are spaced from the disc at a preselected distance so as to form two blending regions between the elements and the disc. The apparatus includes systems for feeding the viscous fluid and particulate solids into the blending chamber, for rotating the blender to cause blending of the liquid and particulate solids and for discharging blended slurry from the slurry holding chamber. Preferably the apparatus includes a system for monitoring the relative amounts of liquid and particulate solids fed into the blending chamber so as to provide a slurry having the desired liquid/-solids ratio.

In one preferred embodiment of the invention, the system for feeding the liquid and particulate solids includes a hydraulically operated fluid pump and a hydraulically operated motor driving an auger conveyor. A hydraulically operated motor rotates the blender and a second hydraulically operated pump extracts slurry from the holding chamber. Hydraulic control valves are included for selectively controlling the speeds of the pumps and motors, thereby enabling selective control of feeding, blending and discharging rates, according to the varying requirements of a particular job. The entire apparatus is preferably trailer-mounted for ease in transporting between job sites.

Comparatively rapid, homogeneous blending of a viscous liquid with particulate solids is achieved with the blending apparatus of this invention. As a result, the apparatus can be compactly constructed so as to (1) enhance its portability, (2) minimize the inventory of blending components and blended slurry within the apparatus and (3) minimize the residence time of the rubber within the apparatus prior to application so as to avoid the adverse effects of extended heating of the rubber. Use of hydraulically operated pumps and motors for feeding, blending and discharging enables rapid, selective variation of feed, blend and discharge rates over wide ranges, thereby greatly enhancing usefulness of the apparatus.

BRIEF DESCRIPTION OF THE DRAWINGS

The invention will be more readily understood by reference to the accompanying drawings, wherein like numerals refer to like elements, and in which.

DETAILED DESCRIPTION OF THE INVENTION

The apparatus of this invention is useful in a wide variety of systems for blending fluids with particulate solids, and is particularly useful for blending viscous fluids, such as hot asphalt, with particulate solids, such as particulate rubber, so as to form a substantially homogeneous slurry in which substantially all of the rubber is wetted with asphalt. Such rubberized asphalt slurries are disclosed in U.S. Pat. No. 4,068,023, the disclosure of which is herein incorporated by reference. While the invention will be described with respect to an apparatus for blending asphalt with particulate rubber, the invention is not so limited.

Figure 1:
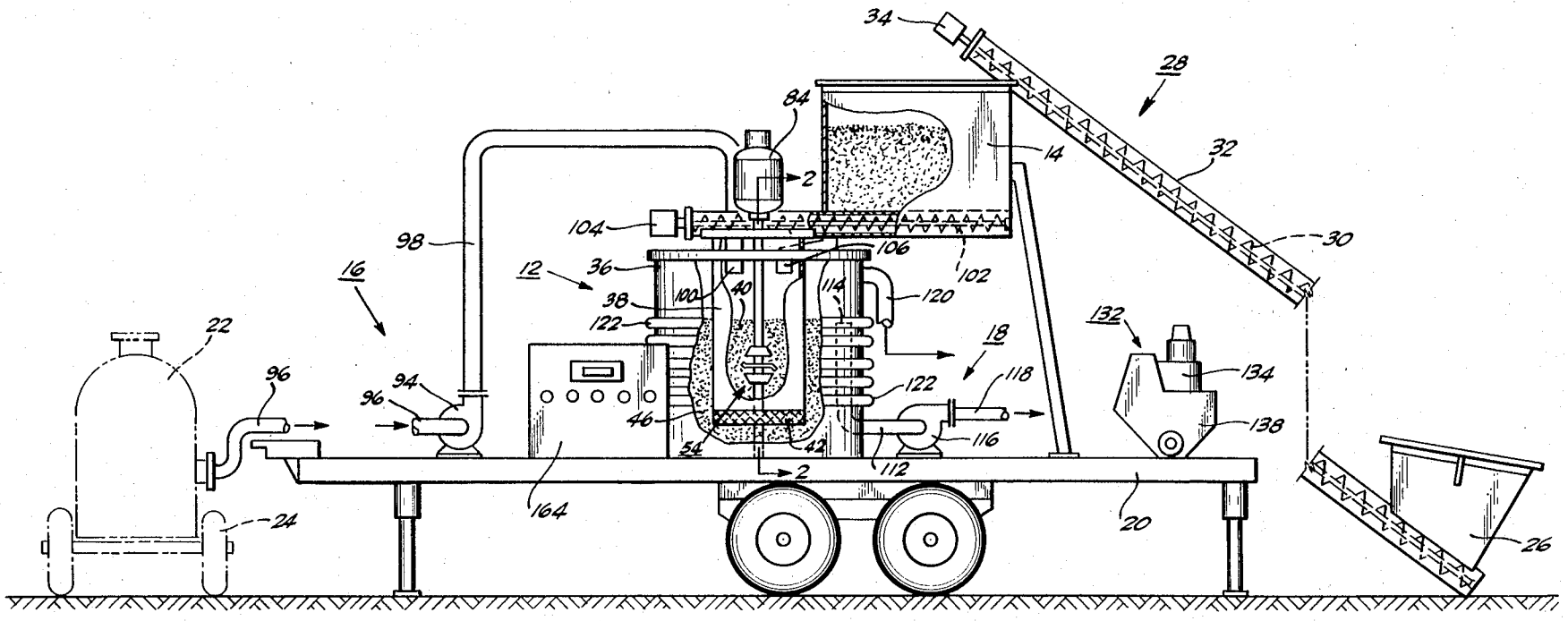
FIG. 1 is an elevational view, partially in cross-section, of one embodiment of the apparatus of this invention.

As shown in FIG. 1, continuous blending apparatus 10 for blending asphalt with ground rubber, comprises generally blending unit 12 having connected, in feeding relationship thereto, ground rubber hopper 14. Apparatus 10 also includes asphalt supply system 16 and blended slurry discharge system. Preferably blending apparatus 10 is of a size and is configured to enable mounting on towable flatbed trailer 20, for ease in transportation between job sites.

Associated with blending apparatus 10 is hot asphalt, blending/supply tank 22 from which asphalt is supplied to blending unit 12 by supply system 16. Preferably, supply tank 22 is of relatively large fluid capacity, compared to that of blending unit 12, so as to provide sufficient asphalt for several hours of continuous operation. Tank 22 is typically mounted on a separate flatbed trailer 24 for site-to-site transportation.

Ground rubber supply bin 26 is provided for containing relatively large quantities of particulate rubber. In terms of supply hours, the capacity of supply bin 26 is preferably comparable to the fluid capacity of asphalt supply tank 22. During operation, particulate rubber is fed from bin 26 to hopper 14 by transporting system 28 which is shown to have elongated auger or worm gear 30 disposed within transport tube 32. Supply bin 26 is mounted on trailer 20 during site-to-site relocation.

Blending unit 12 includes a vertical, cylindrical, substantially closed tank 36 having axially disposed therein a vertical, cylindrical blending vessel 38 which defines therewithin blending chamber 40. Blending vessel 38 is substantially closed except for a lower annular perforate or screened region 42 through which material blended in chamber 40 is discharged.

Relative sizes of tank 36 and blending vessel 38 and the arrangement of vessel 38 within tank 36 are such that contiguous annular and disc-shaped blended slurry holding region 46 is formed around and beneath blending vessel 38, inside tank 36. Preferably, holding region 46 has about the same volume as that of blending chamber 40.

Figure 2:
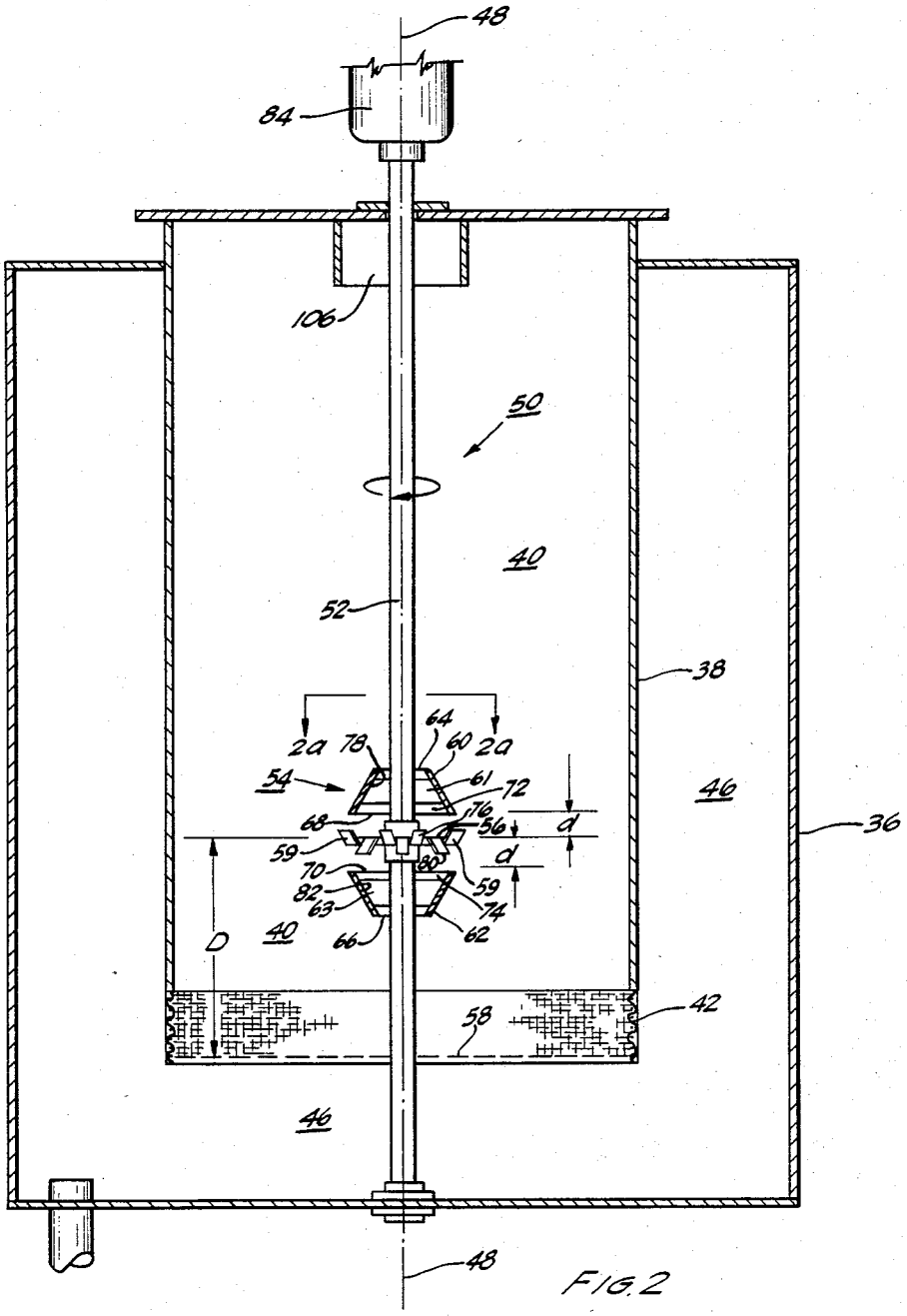
FIG. 2 is a vertical cross-sectional view taken along line 2—2 of FIG. 1.
Figure 2A:
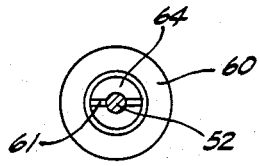
FIG. 2*a* is a horizontal cross-sectional view taken along line 2*a*—2*a* of FIG. 2.

Referring to FIG. 2, rotatably mounted along the common vertical axis 48 of blending vessel 38 and of tank 36 is shear-type blender 50. Blender 50 includes vertical shaft 52 having fixed thereto blender device 54 which functions generally as a double fluid pump. Fixed to shaft 52 at a preselected axial distance "D" above closed bottom 58 of blending vessel 38 is a generally flat impeller disc 56. Radial cuts or elements fixed along the periphery of the disc 56 form a plurality of peripheral edge sections 59, which alternate in being formed or bent upwardly and downwardly to enhance blending. Also fixed to shaft 52 to one side of and above disc 56 is first, hollow upper cone 60. To the other side of and below disc 56 is second, hollow lower cone 62 fixed to shaft 52. Larger, open ends 68 and 70, respectively, of cones 60 and 62 are preferably of the same diameter and about the same or slightly smaller in diameter than disc 56, and each is preferably spaced about the same preselected distance "d" from disc 56. In this preferred special relationship, there are defined a generally conical first upper blending region 72 and second lower blending region 74 between disc 56 and the respective one of cones 60 and 62. First region 72 is defined between upper disc surface 76 and inner surface 78 of upper cone 60 and second chamber 74 is defined between lower disc surface 80 and inner surface 82 or lower cone 60. Hydraulically controlled motor 84 mounted above tank 36 is connected to shaft 52 for rotatably driving blender 50.

In operation, the hot asphalt and particulate rubber introduced into the top portion of blending vessel 38 are blended together by the action of blender device 54, the blended material then being discharged through screened vessel region 42 into holding chamber 46 formed between vessel 38 and tank 36. The blended material, which may be considered a high viscosity slurry, is withdrawn from holding chamber 46 by discharging system 18, to a delivery or spreader truck (not shown) or other point of use.

Referring again to FIG. 1, supply means 16 includes hydraulically operated fluid pump 94, conduit 96 connecting supply tank 22 to pump 94, and conduit 98 connecting pump 94 to an upper inlet aperture 100 of blender unit 12.

Horizontally disposed at the bottom of particulate solid hopper 14 is auger 102, rotatably driven by hydraulic motor 104, for feeding material from hopper 14 through inlet aperture 106 into blending chamber 40.

Discharge system 18 includes conduit 112 having an inlet end extending upwardly into holding chamber 46 between blending vessel 38 and tank 36 to a level 114 which is above blending device 54 so as to establish a slurry level in the blending chamber 40 which is above blending device 54. Discharge system 18 also includes hydraulic motor driven pump 116 connected between conduit 112 and outlet conduit 118 through which the slurry product is conducted to the point of use.

Optionally, blending unit 12 includes overflow conduit 120, which extends into holding chamber 46 between vessel 38 and tank 36 above level 114 and discharges overboard. Heating coils 122 encircle the lower regions of tank 36. Hot oil may be supplied from a source (not shown) to coils 122 for heating materials in unit 12 through a conduit, not shown, connected to a source of heated oil, not shown, associated with asphalt storage tank 22.

Figure 3:
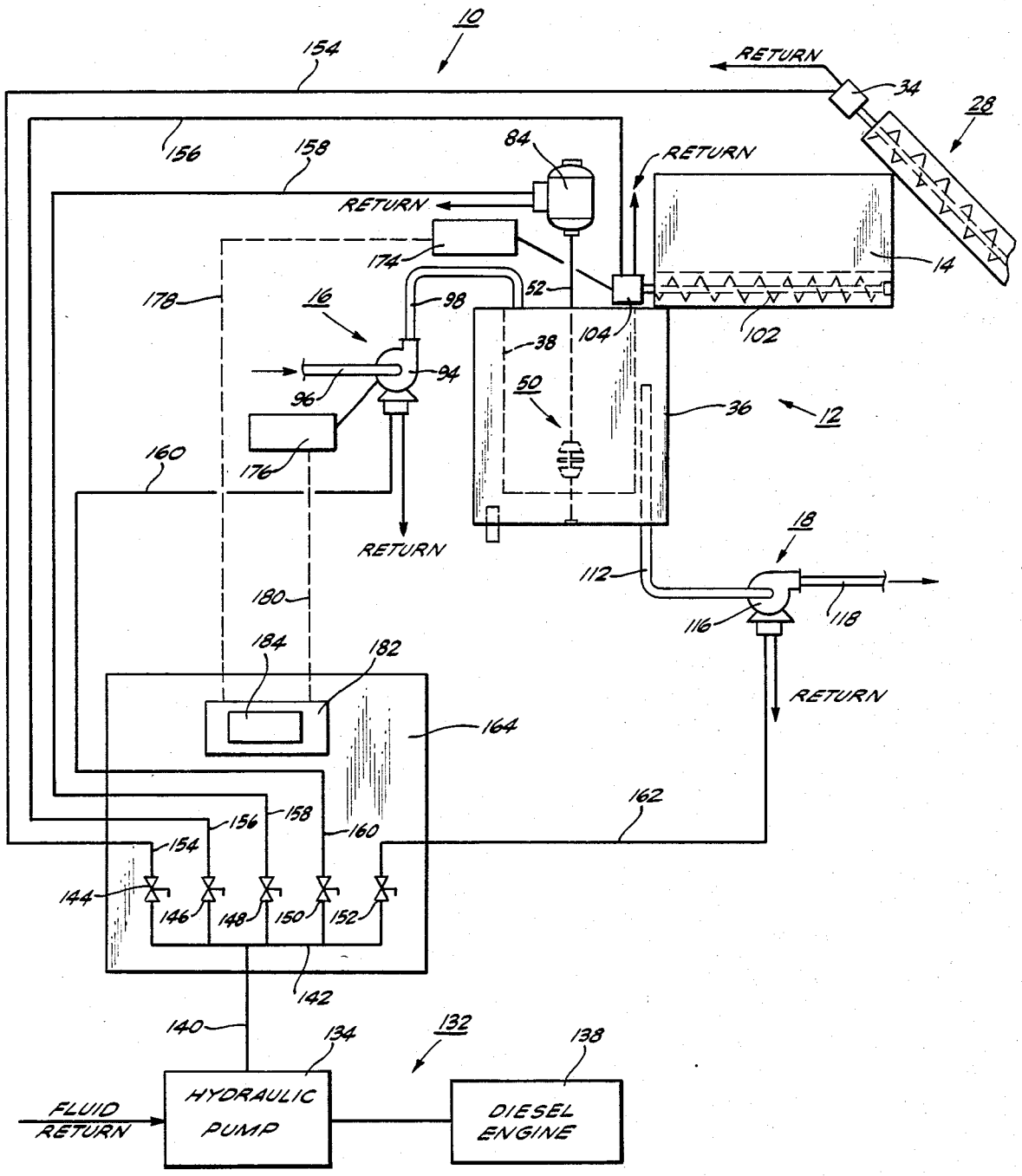
FIG. 3 is a schematic diagram illustrating a preferred embodiment of the hydraulic system of this invention.

As shown in FIG. 3, hydraulic system 132 is provided for controlling hydraulically driven supply pump 94 and discharge pump 116, as well as the two hydraulically driven auger motors 34 and 104 and blender motor 84.

Hydraulic system 132 includes hydraulic pump 134 directly driven by on-trailer diesel engine 138. Connected to hydraulic pump 134 by pressure line 140 is manifold 142 to which flow control valves 144, 146, 148, 150 and 152, respectively, are connected. Hydraulic pressure lines 154, 156, 158, 160 and 162, respectively, connect control valves 144, 146, 148, 150 and 152 to auger motors 34 and 104, blender motor 84 and supply and discharge pumps 94 and 116. These valves 144, 146, 148, 150 and 152 control the flow of hydraulic fluid therethrough and therefore control the speed of the respective motors and pumps 34, 104, 84, 98 and 116, are preferably mounted in control panel or box 164 located near to or on blending unit 12. Speed adjustment of motors 34, 104 and 84 and pumps 94 and 116 is possible by manipulation of hydraulic control valves 144, 146, 148, 150 and 152, respectively. As a result, the blending speed and the flow rates of liquids, solids and slurry are closely controllable to meet the requirements of a particular job. The rate of introduction of asphalt into blending unit 12 by pump 94 is controlled by manipulation of hydraulic control valve 150. Similarly, feeding rate of ground rubber from hopper bin 14 by auger 102 is controlled by hydraulic control valve 146 connected to auger motor 104. Preferably, both auger 102 and fluid supply pump 94 are flow calibrated in volume or pounds of material fed by each rotation of the motor 104 and pump 94. For example, revolution counters 174 and 176 may be connected to motor 104 and pump 94, respectively. Electrical signals from counters 174 and 176 are transmitted by electrical conductors 178 and 180 to ratiometer 182 mounted in control panel 164. Within ratiometer 182, signals from counters 174 and 176 are processed in a manner which will become apparent to those skilled in the art from this description to provide an asphalt/rubber ratio which is in turn indicated on display instrument 184. Then the asphalt/rubber blend ratio can be adjusted, if desired, by the manipulation of one or more control valves 146 and 150.

Similar information may be provided in respect of the speeds of blender motor 84, particulate solid transfer auger motor 34 and/or discharge pump 116 to enable complete monitoring of the apparatus 10.

In one embodiment of the apparatus of this invention, blending unit 12 has a total capacity of about 400 gallons, tank 36 being about four feet high and about four feet in diameter. Blending vessel 38 is about two feet in diameter and 3.5 feet high, so as to have a capacity of about 250 gallons. Lower flow-through region 42 of blending chamber 40 is about four inches high and is formed of three eighths-inch mesh screen. Particulate solids hopper 14 has a capacity of about 18 cubic feet.

For a two foot diameter blending vessel 38, impeller disc 56 is preferably about six inches in diameter, though this diameter may vary from about three to six inches. The distance "d" between larger diameter ends or cones 60 and 62, and impeller disc 56 is preferably between about two and about three inches and more preferably between about 1.5 and about 2.5 inches. The distance "D" of impeller disc 56 above chamber bottom 58 is preferably between about 14 and about 20 inches and more preferably about 16 and about 18 inches.

For typical asphalt/ground rubber weight ratios of between about 2 and about 5, and assuming the ground rubber is about 16 mesh screen size, blender 50 is typically rotated at about 3200 RPM. Flow of slurry from blending unit 12 is about 100 gallons per minute; thereby providing between about one and about 5 minutes of residence time in blending chamber 40. Typically, the asphalt supply temperature, and hence that in blending unit 12 is about 325° to 425° F.

During operation, hot asphalt is continuously fed by pump 94 from supply 22 into blending vessel 38. The feed rate of the asphalt is selectively regulated by manipulation of hydraulic valve 150 which controls the flow of hydraulic pump 94. Ground rubber is continuously fed from hopper 14 into blending vessel 38 by auger 102. The feed rate of the ground rubber from hopper 14 into vessel 38 is selectively regulated by manipulation of hydraulic valve 146 which controls the flow of hydraulic fluid to auger motor 104.

Counters 174 and 176 continuously provide asphalt and ground rubber feed rate data to the ratiometer 182, and the corresponding asphalt/rubber feed, and hence blend, ratio is displayed on instrument 184. One or both of hydraulic control valves 150 and 146 are manipulated until instrument 184 indicates that the desired ratio is being achieved.

Rubber feed rate from bin 26 into hopper 14 is regulated by hydraulic valve 144 which controls flow of hydraulic fluid to auger motor 34 to maintain an adequate supply of rubber in hopper 14. According to particular blending requirements, the rotational speed of blender 54 is regulated by hydraulic valve 148 which controls the flow of hydraulic fluid to blender motor 84.

The discharge rate of blended slurry from holding chamber 46 is regulated, consistent with asphalt and rubber feed rates and as may be dictated by job requirements, by manipulating hydraulic valve 152 which controls the flow of hydraulic fluid to discharge pump 116. Entire operation of apparatus 10 is therefore easily and conveniently operator controlled by the five hydraulic valves 144, 146, 148, 150 and 152.

While particular embodiments of the invention have been described, it will be understood, of course, that the invention is not limited thereto since many obvious modifications can be made, and it is intended to include within this invention any such modifications as will fall within the scope of the claims.

Having now described the invention, we claim:

1. An apparatus for continuously blending in a single stage, a viscous fluid with particulate solids to form a substantially homogeneous slurry, which comprises:

(a) an outer tank;

(b) a blending vessel mounted within said outer tank so as to define (1) a blending chamber within said vessel spaced inwardly from the walls of said outer tank and (2) a blended fluid and particulate solid slurry holding chamber around said blending vessel and within said outer tank, said blending vessel being substantially closed except for lower regions which allow fluid communication from said blending chamber into said holding chamber;

(c) a blender comprising (1) a blender shaft rotatably mounted in said blending vessel, (2) a blending disc fixed to said shaft a first selected distance above the bottom of said blending vessel and (3) first and second hollow blending elements, said first element being fixed to said shaft on one side of said disc and said second element being fixed to said shaft on the opposite side of said disc, each of said blending elements having an open larger diameter end thereof facing said disc and being spaced at a second preselected distance from said disc so as to define first and second blending regions between said disc and said first and second blending elements, respectively;

(d) feeding means for feeding said fluid and particulate solids into said blending chamber;

(e) means for rotating said blender to cause blending of said fluid and particulate solids in said blending chamber; and (f) discharging means for discharging said slurry from said holding region.

2. The apparatus defined in claim 1 further comprising monitoring means for monitoring the relative amounts of said fluid and said particulate solids fed into the blending chamber by said feeding means.

3. The apparatus defined in claim 1 wherein said discharging means comprises a conduit communicating with said slurry holding region, said conduit having a slurry receiving inlet opening for withdrawing said slurry from said holding chamber at a level above the level of said disc and blending elements, such that, during operation, said disc and blending elements will be submerged in a body of said liquid within said blending chamber.

4. The apparatus defined in claim 1 wherein said second preselected distance is between about 1 and about 3 inches.

5. The apparatus defined in claim 1 wherein said second preselected distance is between about 1.5 and about 2.5 inches.

6. The apparatus defined in claim 1 wherein said blending elements are conical in shape, each having a larger diameter open end facing the blending disc, and a smaller diameter open end facing away from the blending disc.

7. The apparatus defined in claim 6 wherein said larger diameter ends of said blending elements have about the same or slightly smaller diameter than said blending disc.

8. The apparatus defined in claim 1 wherein said feeding means comprise (1) a pump for pumping said viscous fluid from a source into said blending chamber and (2) a motor-driven auger for feeding particulate solids from a supply bin into said blending chamber, at least one of said pump and said motor being selectively controllable so as to enable selective variation of the fluid/solid ratio of said slurry.

9. The apparatus defined in claim 1 further comprising means for monitoring the fluid/solid blending ratio.

10. The apparatus defined in claim 9 wherein said monitoring means includes a ratiometer having a display indicating said blending ratio.

11. The apparatus defined in claim 1 wherein said first preselected distance is between about 14 and about 20 inches.

12. The apparatus defined in claim 1 wherein said blending disc has alternately upturned and downturned mixing elements disposed about its periphery, said mixing elements being adapted to enhance the blending of said liquid and said solids within said blending regions.

13. The apparatus defined in claim 1 further comprising means connected to said outer tank for heating said slurry in said holding chamber.

14. The apparatus defined in claim 1 wherein the volume of said holding chamber is approximately equal to the volume of said blending chamber.

15. An apparatus for continuously blending in a single stage, asphaltic material with particulate rubber to form a substantially homogeneous slurry, which comprises:

(a) a base;

(b) a substantially closed cylindrical tank mounted on said base;

(c) a generally cylindrical blending vessel coaxially disposed in said tank, said blending vessel being inwardly spaced from said tank in side and bottom regions so as to define (1) a blending chamber within said blending vessel and (2) a slurry holding chamber between said tank and said blending vessel, said vessel being substantially closed except for a lower cylindrical section thereof which is adapted for fluid communication between said blending chamber and said holding chamber so as to allow the discharge of blended slurry from said blending chamber into said holding chamber;

(d) a blender comprising a (1) a blender shaft rotatably and coaxially mounted within said blending vessel, (2) a blending disc fixed to said shaft a first preselected distance above the bottom of said blending vessel, said disc being formed having a plurality of alternately turned up and turned down mixing elements disposed around its periphery, (3) a first hollow cone fixed to said shaft above said disc, and (4) a second hollow cone fixed to said shaft below said disc, the larger diameter open ends of said cones facing said disc and being spaced therefrom a preselected distance;

(e) pumping means for feeding said asphaltic material from a fluid reservoir into said blending chamber;

(f) conveying means for feeding said particulate rubber from a solids reservoir into said blending chamber;

(g) control means for selectively varying the rates of at least one of said pumping means and said transport means so as to enable selective variation of the asphaltic material and particulate rubber blending ratio of said slurry;

(h) drive means connected to said shaft for rotating said blender at selectively variable speeds; and (i) discharging means communicating with said holding chamber for discharging slurry therefrom.

16. The apparatus defined in claim 15 wherein said discharging means comprises a conduit extending through a wall of said tank into said slurry holding chamber, said conduit having a slurry inlet end at an elevation above that of said blending disc and said blending cones.

17. The apparatus defined in claim 15 further comprising monitoring means for monitoring the feeding rate by said pumping means of asphaltic material into said blending chamber and the feeding rate by said conveying means of particulate rubber into said blending chamber, and for calculating therefrom the asphaltic material/particulate rubber blending ratio of said slurry.

18. The apparatus defined in claim 17 wherein said monitoring means includes means for displaying said calculated blending ratio.

19. The apparatus defined in claim 15 wherein said base comprises a trailer adapted to enable the apparatus to be towed from one location to another.

20. The apparatus defined in claim 15 wherein said preselected distance between the open ends of said cones and said disc is between about 1 and about 3 inches.

21. An apparatus for continuously blending in a single stage hot asphaltic material with ground rubber to form a substantially homogeneous slurry, which comprises:

(a) a transporter;

(b) a generally cylindrical, substantially closed tank mounted upright on said transporter;

(c) a generally cylindrical blending vessel coaxially disposed within said tank so as to define (1) a blending chamber within said vessel and (2) a slurry holding chamber between said vessel and the walls of said tank, said vessel being substantially closed except for a lower cylindrical section thereof which is adapted for fluid communication between said blending chamber and said holding chamber so as to allow the discharge of blended slurry from said blending chamber into said holding region;

(d) a blender comprising (1) a blender shaft rotatably and coaxially mounted within said blending vessel, (2) a blending disc fixed to said shaft at an elevation above the top of said lower cylindrical section of said vessel, and (3) first and second hollow blending cones coaxially mounted on said shaft and spaced at a preselected distance between about 1 and about 3 inches above and below said disc, respectively, the larger diameter open ends of said cones facing said disc to form first and second blending regions between said disc and said first and second cones, respectively;

(e) pumping means mounted on said transporter for pumping said asphaltic material from a fluid reservoir into the top of said blending chamber at a selectively variable feed rate, said pumping means including a first hydraulically driven pump;

(f) conveying means mounted on said transporter for feeding said ground rubber from a solids reservoir into the top of said blending chamber at a selectively variable feed rate, said conveying means including a hopper mounted on said tank in feeding relationship with said blending chamber, a conveyor mounted on said transporter for transporting ground rubber from the hopper to a feed opening from the hopper into the blending chamber and a first hydraulically driven motor connected to said conveyor;

(g) drive means mounted on said tank for rotating said blender at a selectively variable speed, said drive means including a second hydraulically driven motor connected to said blender shaft;

(h) discharging means mounted on said transporter for discharging blended slurry from said holding chamber at a selectively variable discharge rate, said discharging means including a second hydraulically driven pump;

(i) hydraulic means mounted on said transporter and operably connected to (1) said first pump, (2) said first motor, (3) said second motor, and (4) said second pump for selectively controlling the respective material feeding, blending and discharging rates from a common control station mounted on the transporter.

22. The apparatus defined in claim 20 further comprises means mounted on said transporter for determining the relative feed rates of said asphaltic material and said ground rubber into said blending chamber, for determining therefrom the corresponding asphaltic material/ground rubber blending ratio of said slurry, and for displaying said ratio on a display device mounted on said transporter.

23. The apparatus defined in claim 15 or 20 wherein said preselected distance between the open ends of said cones and said disc is between about 1.5 and about 2.5 inches.

24. The apparatus defined in claims 15 or 20 further comprising heating means for heating blended slurry in said holding region, said heating means comprising heating coils surrounding said tank.

* * * * *